United States Patent [19]

Isenhoff

[11] 4,324,031

[45] Apr. 13, 1982

[54] BATTEN SEAMING MACHINE

[75] Inventor: Eric H. Isenhoff, Angola, Ind.

[73] Assignee: Roof Systems, Inc., Grand Rapids, Mich.

[21] Appl. No.: 164,072

[22] PCT Filed: Aug. 15, 1979

[86] PCT No.: PCT/US79/00628

§ 371 Date: Jun. 30, 1980

§ 102(e) Date: Jun. 30, 1980

[51] Int. Cl.[3] ..... B23P 11/00

[52] U.S. Cl. ..... 29/243.58; 29/243.5

[58] Field of Search ..... 29/243.5, 243.58; 113/54 R, 55, 58, 1 N; 72/48, 121

[56] References Cited

U.S. PATENT DOCUMENTS

| | | | |
|---|---|---|---|
| 1,976,148 | 10/1934 | Sonntag | 113/55 |
| 2,160,336 | 5/1939 | Maxfield | 113/55 |
| 3,120,828 | 2/1964 | Gronlund | 113/55 |
| 3,487,799 | 1/1970 | Gronlund | 113/55 |
| 3,609,845 | 10/1971 | Taylor | 29/243.5 |
| 3,662,699 | 5/1972 | Horn et al. | 113/55 |
| 3,771,482 | 11/1973 | Thompson | 113/55 |
| 3,773,005 | 11/1923 | Day et al. | 113/55 |
| 3,875,642 | 4/1975 | Knudson | 29/243.5 |
| 4,064,819 | 12/1977 | Fox | 113/55 |

*Primary Examiner*—Leon Gilden

*Attorney, Agent, or Firm*—Varnum, Riddering, Wierengo & Christenson

[57] ABSTRACT

A seaming machine for securing a batten to a roof rib includes a housing (24) having two longitudinal sections (25, 29) which are pivotably secured together about a vertical axis. A cam locking arrangement is provided at the rear of the housings to lock the housing sections (25, 29) together when the machine is positioned on a roof rib. The cam locking arrangement includes a pair of vertically spaced cams (102, 104) which engage a pin (50) disposed in one of the housing sections (25). The seaming machine comprises three pairs of horizontally disposed rollers (52, 54, 56) which progressively bend a flange on a batten against a roof rib, with the rollers engaging the sides of the roof rib to drive the machine along the rib. Vertical pinch rollers (76) are provided between the second and third stage horizontal rollers (54, 56) to crimp the flange on the batten against the roof rib. In this way, a secure and waterproof connection of the batten to the roof rib is provided.

19 Claims, 10 Drawing Figures

BATTEN SEAMING MACHINE

BACKGROUND OF THE INVENTION

1. Field of the Invention

The invention relates to a seaming machine for securing a batten to an upstanding roof rib on a metal roof construction.

2. Background Art

Metal roofs are often used on buildings of various sizes and shapes. Typically, the roofs are formed from a plurality of metal panels including upstanding flanges arranged in a side-by-side relationship which are joined together by a seam.

One type of roof construction is shown in U.S. Pat. No. 4,089,145, issued May 16, 1978, wherein a cleat is secured to an upstanding roof rib having a generally T-shaped cross-section. The cleat or batten has flanges which are turned under the horizontal flanges on the roof rib.

In forming a seam for securing the above-described cleat to a T-shaped roof rib, seaming machines generally turned or bent the flange into the desired position. The machines which had been used to form such a seam typically included a series of horizontally-disposed rollers which progressively bent the flanges. No crimping of the flange against the roof rib was generally performed. One such roof seaming machine, disclosed in U.S. Pat. Nos. 3,120,828 issued Feb. 11, 1964, and 3,487,799 issued Jan. 6, 1970, includes a series of spaced rollers which bend a flange on a roof panel over an adjacent flange. Pairs of horizontally-disposed rollers engage opposite sides of an upstanding roof rib to define a forming surface between the adjacent rollers. The pairs of horizontal rollers are spring biased to maintain them in engagement with a roof rib.

In U.S. Pat. No. 3,662,699 issued May 16, 1972, vertical as well as horizontal rollers perform the seaming operation. Flanges on adjacent panels are first crimped together by the vertically disposed rollers while the final turning and crimping operation is performed by spring biased horizontal rollers.

Another machine for forming a rolled seam between adjacent flanges is disclosed in U.S. Pat. No. 3,773,005, issued Nov. 20, 1973, wherein the housing for the pairs of horizontally disposed rollers is split along a horizontal axis. One section of the housing is pivoted upwardly about the horizontal axis to allow the machine to be removed at any point along a roof rib.

DESCRIPTION OF THE INVENTION

The roof construction such as that disclosed in U.S. Pat. No. 4,089,145 includes an elongate batten which is crimped over horizontally extending flanges on an upstanding roof rib. The batten is secured to the roof rib by folding the flanges upwardly against the horizontal flanges on the roof rib which eliminates the need for hammering the cleat into place or forming a rolled seam.

In accordance with the invention, a seaming machine for securing such a batten in place includes a housing for a gear system which drives rollers for carrying out the seaming operation. The housing is split longitudinally so that the sections are pivotable about a vertical axis disposed in the front portion of the housing. A locking means is disposed at the rear portion of the housing for securing the pivotable sections in a closed position so that the machine rides over the roof rib. The locking means typically includes a pair of cam locks which are pivotably mounted on one section of the housing for engaging a pin disposed in the opposite housing section.

Bending of the batten flanges over the upstanding roof rib is performed by three pairs of horizontally-disposed rollers. Each pair of rollers includes a driving portion which engages opposite sides of the upstanding roof rib and a forming surface which engages a leading edge of the flange on the batten. The portion of each roller which engages the roof rib is typically covered with a neoprene layer to improve the gripping action. The rollers are driven by a worm and bevel gear arrangement so that the machine is self-propelled along the roof rib.

Cooperating pairs of vertically arranged rollers are disposed between the second and third horizontal rollers to complete the crimping operation. Each pair of vertical rollers engages the top surface of the batten and the bottom of the flange to crimp the flange against the roof rib. The use of both horizontal and vertical rollers to form the crimp insures a secure fastening of the batten to the roof rib.

In providing a split housing, the machine can be removed from a roof rib at any point during the seaming operation. In this way, the machine can be removed at the end of the seaming operation without the need for reversing the operation of the machine and running it back over a previously formed seam. The cam locks provide a positive engagement of the housing sections when the machine is positioned on a roof rib.

The horizontal rollers also provide for a self-propelled seaming machine which reduces the time necessary for constructing the roof. A self-propelled machine also allows the formation of seams in vertically extending panels.

The rollers which secure the batten to the roof rib perform a bending operation similar to that which is used to form the roof panel configurations. The seaming machine in essence is a continuation of that shaping process, as it performs the final bending of the batten flanges into the desired position against the roof rib.

BRIEF DESCRIPTION OF THE DRAWINGS

The invention will be described with reference to the accompanying drawings wherein like members bear like reference numerals and.

DETAILED DESCRIPTION OF THE PREFERRED EMBODIMENT

Figure 1:
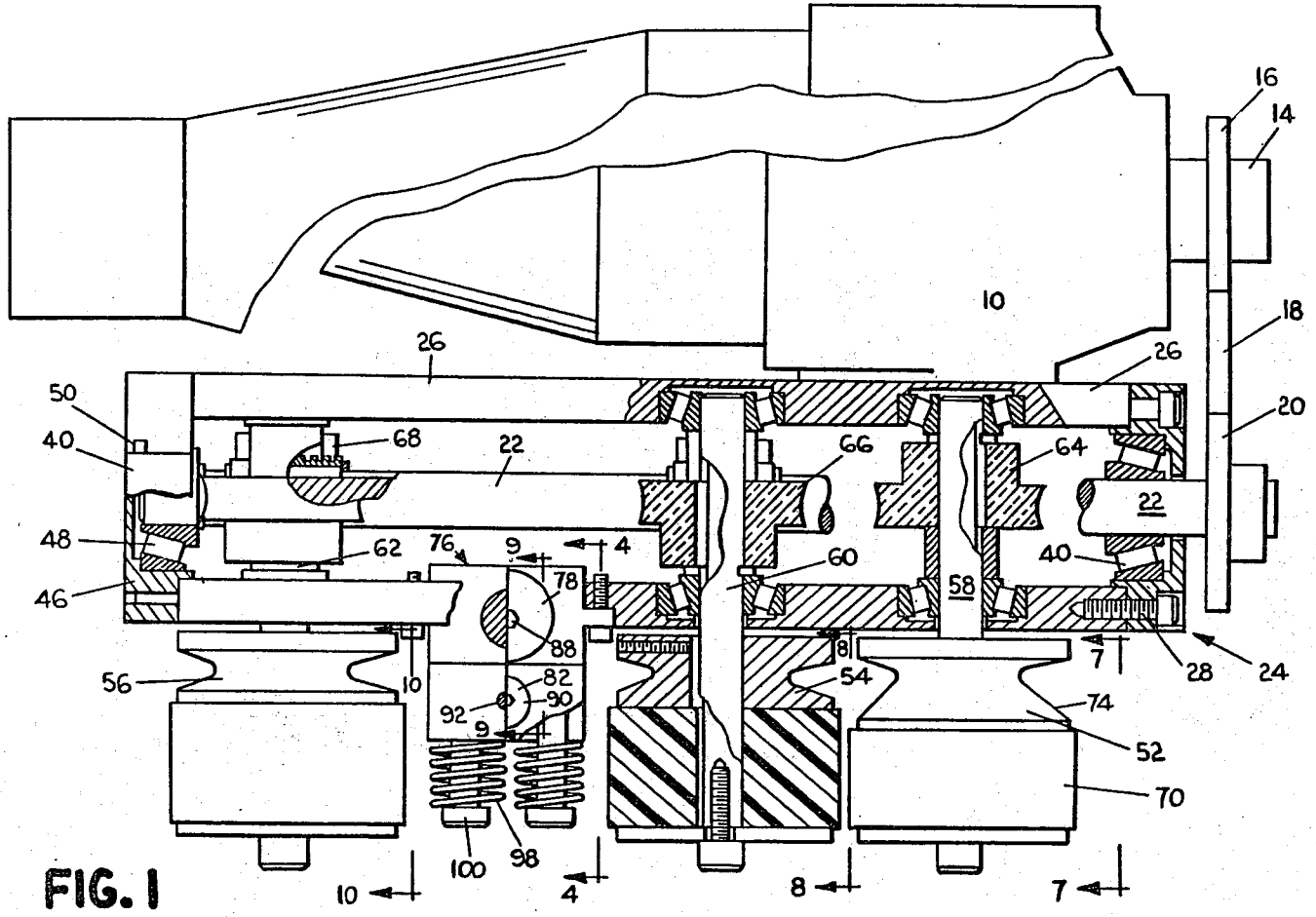
FIG. 1 is a partial brokenaway, elevational view of the seaming machine showing the rollers and gear-driving arrangement.
Figure 2:
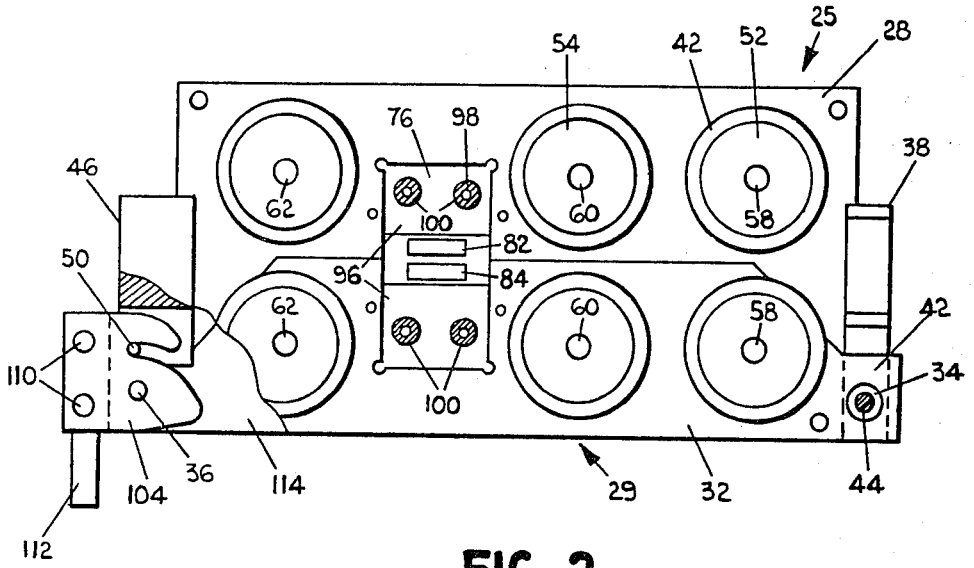
FIG. 2 is a bottom plan view of the seaming machine partially cut away to show the cam lock arrangement.

With reference to FIGS. 1 and 2, the seaming machine includes a motor enclosed within a housing 10 mounted on a gear box housing 24. The motor is typically a three-quarter horsepower drill motor such as Rockwell Model No. 77751. A handle is mounted on the housing 10 for guiding the seaming machine along a roof rib. The motor is operated in a conventional manner, such as by providing a switch on the housing 10.

The motor drives a shaft 14 having a sprocket 16 disposed at one end thereof. The sprocket 16 carries a chain 18 which drivingly engages a sprocket 20 disposed on an end of a worm gear 22 mounted within the gear box housing 24.

The gear box housing 24 comprises two longitudinally extending sections 25 and 29. The first housing section 25 includes a top plate 26 and a bottom plate 28 which are spaced apart to define a longitudinal housing. Secured to the front and back portions of the first housing section 25 are bearing mounts 38 and 46 in which the worm gear 22 is journalled. The second housing section 29 likewise includes a top and bottom plate 30 and 32 which define a desired configuration for bending a flange on a batten into the desired position. As shown in FIG. 1, the forming surfaces 74 on the pairs of rollers are progressively more angled to provide the desired bending of a flange on the batten.

Figure 4:
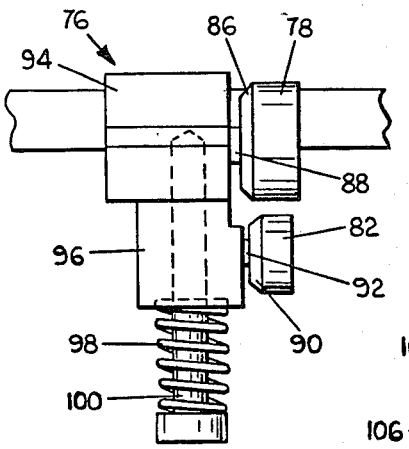
FIG. 4 is a partial cross-sectional view taken along line 4—4 of FIG. 1 showing the vertical pinch rollers.
Figure 5:
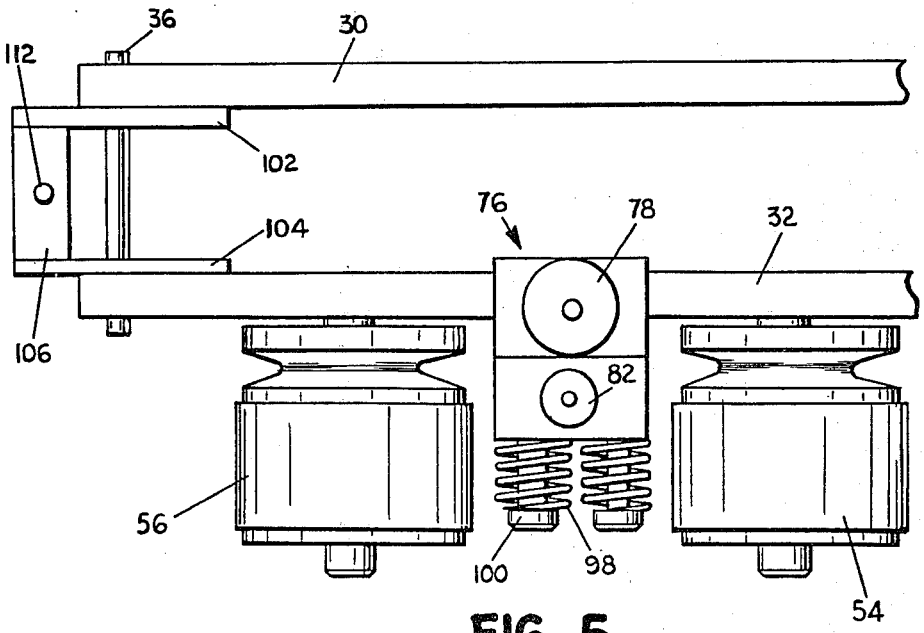
FIG. 5 is a partial cross-sectional view of a portion of the housing in which the cam lock mechanism is carried.

Disposed between the second and third horizontal roller pairs 54 and 56 is a vertical pinch roller assembly 76 illustrated in FIGS. 4 and 5. The vertical assembly 76 includes two pair of vertical rollers with each pair disposed in opposite housing sections. Upper rollers 78, 80 are secured to shafts 88, 89, each of which is journalled within an upper bearing carrier 94, 95. Bottom rollers 82, 84 are likewise carried on shafts 92, 93, each of which is journalled within a lower bearing carrier 96, 97. The sets of upper and lower bearing carriers 94, 95 and 96, 97 are vertically arranged and joined together by threaded shafts 100 which carry coil springs 98 for permitting relative displacement of the bearing carriers when the rollers, for example, encounter an irregular surface on the batten. The threaded shafts 100 tend to urge against the springs 98 to maintain the bearing carriers in contact. The upper rollers 78 and 80 are typically of a larger diameter than the lower rollers 82, 84. The portion of the upper roller adjacent the bearing carrier 94, which rides over the outer portion of a batten, includes a slightly frusto-conical surface. The bottom rollers 82, 84 also include a frusto-conical surface 90 typically formed at an angle of approximately 30°. The frusto-conical portions provide for less crimping of the outer section of the batten relative to the portion of the batten flange adjacent the upstanding roof rib.

Figure 6:
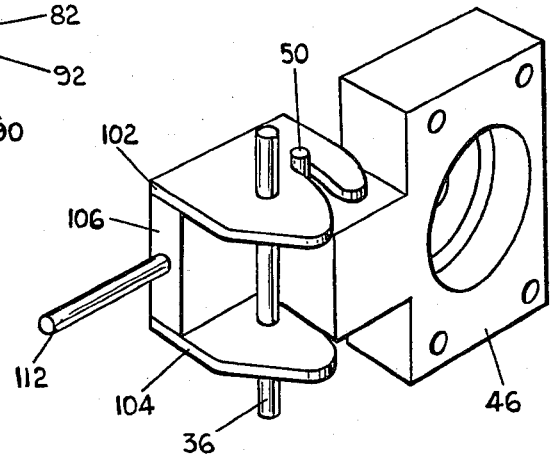
FIG. 6 is a perspective view of the cam locking arrangement.

The cam locking arrangement of the invention is carried at the rear portion of the housing 24. As shown in FIG. 6, the locking arrangement includes two cams 102, 104 which are vertically spaced apart by a spacing member 106. The cams are secured to the top and bottom surfaces of the spacing member 106 by bolts 110.

The cams 102, 104 each include an aperture 108 through which a pin 36 journalled in housing section 29 is a longitudinal housing.

The front bearing mount 38 attached to the first housing section 25 carries a bearing 40 in which the front portion of the worm gear 22 is journalled. The bearing mount 38 has a generally rectangular configuration with a flange portion 42 extending from a side thereof. The flange portion 42 extends into the second housing section 29 between the top and bottom plates 30 and 32. The flange 42 includes a bore 44 which is in alignment with respective bores in each of the top and bottom plates of the housing section 29. A pin 34 inserted through the bores pivotably connects the two housing sections.

The rear bearing mount 46 carries a bearing 48 in which the rear portion of the worm gear 22 is journalled. The rear bearing mount 46 also has a generally rectangular configuration including a flange 49 which extends between the top and bottom plates of the second housing section 29. A vertically arranged dowel 50 carried on this extending flange 49 engages a cam locking arrangement to be described below.

The worm gear 22 drives a series of horizontally-disposed roller pairs 52, 54 and 56 which are rotatably supported at the bottom of the gear box 24 and a vertical pinch roller assembly 76. As shown in FIG. 2, the horizontally-disposed roller pairs include two rollers, each of which is mounted in opposite sections 25, 29 of the housing 24. The rollers are secured to shafts 58, 60, 62 which carry a bevel gear 64, 66, 68 for meshing with the worm gear 22. Power supplied by the motor is transmitted through the chain and sprocket drive to the worm-and-bevel gear arrangement to drive the rollers. The shafts 58, 60, 62 are journalled in bearings carried in the top and bottom plates of each housing section.

Figure 3:
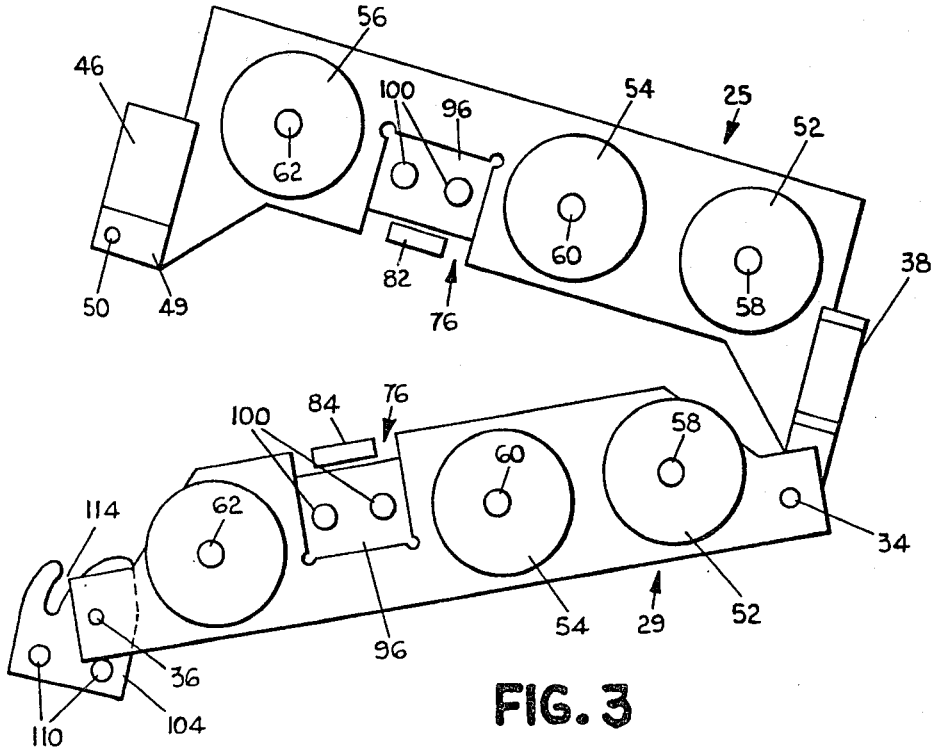
FIG. 3 is a bottom plan view of the seaming machine showing the housing in an open position.

Each roller includes a drive portion 70 which engages an upstanding roof rib on a roof construction. The drive portion 70 is typically covered with a deformable surface 72 such as a neoprene rubber layer for grippingly engaging the roof rib. A forming surface 74 carried on the roller 50 has inserted. In this way, the cams are pivotally mounted so as to provide for opening and closing of the two housing sections. The cams 102 and 104 each include a slot 114 for engaging the dowel 50 carried in the rear bearing mount 46. A handle 112 is provided on the spacing member 106 for pivoting the cams 102, 104 about a vertical axis so as to disengage them from the dowel 50, as shown in FIG. 3. The roof construction, which is shown in FIGS. 7–10, includes an upstanding roof rib 120 having a T-shaped cross-section. The rib 120 is formed by flanges 121 and 122 of adjacent panels of the roof. A batten or cleat 124 which is secured to the rib to form a seam includes a central web 125 from which a pair of side flanges 126 and 127 depend. The side flanges 126 and 127 are typically bent at an angle relative to the central web 125 during formation of the batten, as illustrated. The seaming operation to be described further bends the flanges onto the rib 120 to complete the seam.

Figure 7:
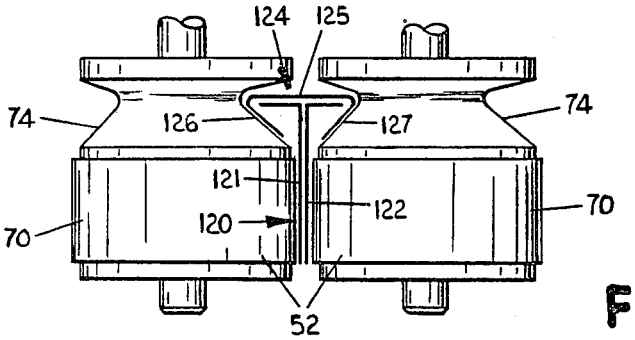
FIG. 7 is a view of the first pair of rollers along line 7—7 of FIG. 1 showing the bending of the flanges.
Figure 8:
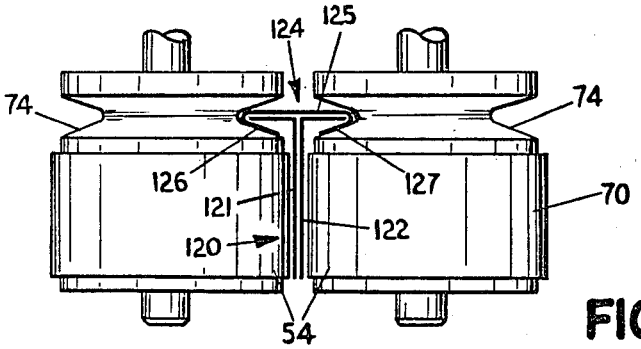
FIG. 8 is a view of the second pair of rollers along lines 8—8 of FIG. 1 showing the bending of the batten flanges.
Figure 9:
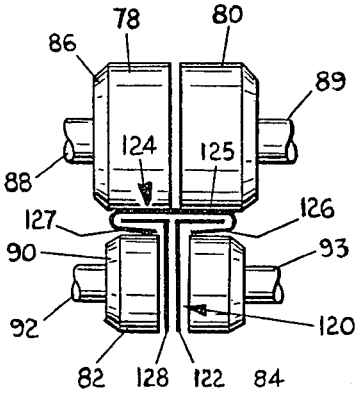
FIG. 9 is a view of the vertical pinch rollers along line 9—9 of FIG. 1 showing the crimping of the batten flanges.
Figure 10:
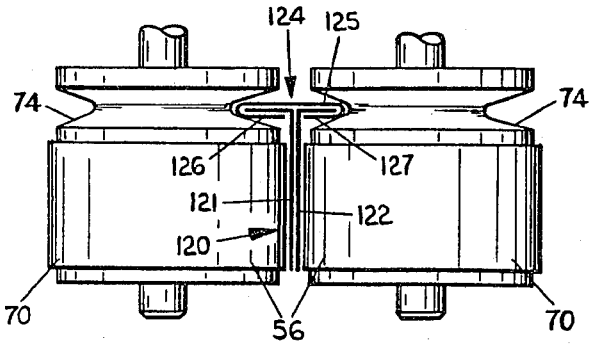
FIG. 10 is a view of the third pair of rollers along lines 10—10 of FIG. 1 showing the final bending stage.

In operation, the seaming machine is placed on a roof rib formed by the upstanding flanges of adjacent roof panels. A batten including a pair of side flanges which are crimped to the roof rib, as will described, is positioned on top of the rib. The three pairs of rollers 52, 54, 56 engage the opposite side surfaces of the flanges on the roof rib to drive the machine. The rollers are driven by the worm gear and bevel gear arrangement, with the worm gear, in turn, being driven by the chain and sprocket. As the seaming machine rides over the roof rib, the leading edges of the batten are engaged by the forming surfaces 74 on the rollers as shown in FIGS. 7 and 8. The forming surfaces 74 are progressively more angled so as to further bend the flanges on the batten upwardly into position. With reference to FIG. 9, the vertical roller assembly 76 crimps the flange on the batten against the roof rib. The top roller of the vertical roller assembly engages the top surface of the batten while the lower roller engages the flange portion on the batten to provide a secure and watertight connection. It should be noted that the third pair of rollers 56 serve mainly to compress the crimped seam, as shown in FIG. 10, and drive the machine along the rib.

Accordingly, the seaming machine provides for securing of a batten to a roof rib in a relatively simple manner. The machine is self-propelled along the roof rib which decreases construction time and allows for the installation of vertically arranged walls. Additionally, the bending of the flange on the batten takes place in the same direction as which the batten was originally formed. The flanges are progressively bent in a fashion similar to the cold-working forming process which is used to shape the roof panels. In this way, the stress induced during the seaming operation as well as deformation in the flanges is reduced. It should be noted that the biasing force on the vertical pinch rollers is pre-set according to the thickness of the sheet being crimped.

The cam locking arrangement allows the machine to be removed from a roof rib at any point along its travel. When the seaming machine is placed on a roof rib, the two housing sections are swung towards each other so that the bevel gears engage the worm gear. The cam locks are then pivoted about the vertical axis to engage the slots 114 with the dowel pin 50. The configuration of the slot 114 is such that the housing sections are pulled towards each other by the riding of the pin within the slot. If it is desired to disengage the seaming machine from the roof rib, the cam locks are pivoted counterclockwise about the pin. During pivoting of the cams, the dowel pin 50 rides within the slot 114 and tends to spread the two housing sections apart.

A housing which is pivotable about a vertical axis permits the seaming machine to be placed on either a horizontally or vertically arranged rib. The machine is also easily removed from the rib at the end of the crimping operation without the need for driving the machine back over the previously formed seam, as is necessary in a unitary-body seaming machine.

The foregoing specifications and drawings are merely illustrative of the present invention and are not intended to limit the invention to the disclosed embodiment. Variations and changes which are obvious to one skilled in the art are intended to be within the scope and nature of the invention which are defined by the appended claims.

The embodiments of the invention in which an exclusive property or privilege is claimed are defined as follows:

1. A seaming machine for securing a batten having inwardly extending side flanges to an upstanding roof rib having horizontally-extending webs, said machine comprising:

a housing including first and second sections pivotable between an opened and closed position about a vertical axis;

releasable locking means for securing said first and second sections in the closed position whereby said machine is adapted to ride on an upstanding roof rib;

at least one pair of horizontally-disposed rollers each including a driving portion adapted to engage a side surface of the upstanding roof rib and a forming surface adapted to engage a flange on a batten for bending said flange upwardly against a horizontally-extending web on said roof rib, one of each of said pair of rollers being mounted in said first and second sections of said housing to thereby engage the opposite side surfaces of said roof rib when the housing is in a closed position to drive said machine along the rib; and spring-biased vertically-arranged rollers adapted to crimp the flange on the batten against the horizontally-extending web on the upstanding roof rib, said vertically-arranged rollers including at least one upper roller for engaging a top surface of said batten and a pair of lower rollers for engaging said flanges extending from opposite sides of the upstanding roof rib.

2. The seaming machine of claim 1 wherein said releasable locking means includes cam means for riding over a pin carried on said housing.

3. The seaming machine of claim 2 wherein said vertical axis about which the housing sections are pivotable is disposed at a front portion of said housing and said cam means is carried on a rear portion of said housing.

4. The seaming machine of claim 3 wherein said cam means includes two vertically-spaced cam members which ride over the pin on said housing.

5. The seaming machine of claim 4 wherein said two cam members are pivotably mounted at the rear of said second housing section.

6. The seaming machine of claim 5 wherein said two cam members include camming surfaces having a configuration which spreads the two housing sections apart when the cam members are pivoted.

7. The seaming machine of claim 1 wherein said at least one pair of horizontally-disposed rollers are mounted on shafts carrying a bevel gear at one end and a longitudinally-extending worm gear is journalled in said housing for meshing with said bevel gear.

8. The seaming machine of claim 7 wherein said worm gear is journalled in said first housing section.

9. The seaming machine of claim 1 wherein said driving portion of said at least one pair of horizontally-disposed rollers includes a deformable surface for gripping engagement with said upstanding roof rib.

10. The seaming machine of claim 9 wherein said deformable surface is a neoprene rubber layer.

11. The seaming machine of claim 1 including three pair of horizontally-disposed rollers longitudinally spaced along said housing.

12. The seaming machine of claim 11 wherein said vertically-arranged rollers are arranged between said second and third pair of horizontally-disposed rollers.

13. The seaming machine of claim 12 wherein said three pairs of horizontally-disposed rollers include forming surfaces which progressively bend said flange on the batten upwardly against the web on the roof rib.

14. The seaming machine of claim 1 wherein said spring-biased, vertically-arranged rollers are biased by a predetermined spring force.

15. The seaming machine of claim 14 wherein each of said vertically-arranged rollers includes a generally annular surface having a frustro-conical portion which is positioned adjacent a distal portion of the web on said upstanding roof rib.

16. The seaming machine of claim 15 wherein said vertically-arranged rollers include two upper rollers with each of said two rollers being mounted in one of said first and second sections.

17. The seaming machine of claim 16 wherein each of said pair of lower rollers is mounted in one of said first and second sections.

18. The seaming machine of claim 17 wherein said vertically-arranged rollers include upper and lower rollers of different diameters.

19. The seaming machine of claim 18 wherein said upper rollers are of a larger diameter relative to said lower rollers.

* * * * *

UNITED STATES PATENT AND TRADEMARK OFFICE

CERTIFICATE OF CORRECTION

PATENT NO. : 4,324,031

DATED : April 13, 1982

INVENTOR(S) : ERIC H. ISENHOFF

It is certified that error appears in the above-identified patent and that said Letters Patent are hereby corrected as shown below:

Column 4, line 3, commencing with "a longitudinal housing", and to and including "on the roller 50" in Column 4, line 42, should follow "define" in Column 3, line 31.

Column 4, line 64, after "will" insert --be--

Signed and Sealed this

*Twenty-seventh* Day of *July 1982*

[SEAL]

*Attest:*

GERALD J. MOSSINGHOFF

*Attesting Officer*

*Commissioner of Patents and Trademarks*